US007682132B2

(12) United States Patent
Sugimoto et al.

(10) Patent No.: US 7,682,132 B2
(45) Date of Patent: Mar. 23, 2010

(54) DOUBLE JET FILM COOLING STRUCTURE

(75) Inventors: Takao Sugimoto, Kobe (JP); Ryozo Tanaka, Kakogawa (JP); Koichiro Tsuji, Akashi (JP); Dieter Bohn, Moers (DE); Karsten Kusterer, Moresnet (BE)

(73) Assignee: Kawasaki Jukogyo Kabushiki Kaisha, Kobe-shi (JP)

( * ) Notice: Subject to any disclaimer, the term of this patent is extended or adjusted under 35 U.S.C. 154(b) by 640 days.

(21) Appl. No.: 11/599,358

(22) Filed: Nov. 15, 2006

(65) Prior Publication Data

US 2007/0109743 A1 May 17, 2007

(30) Foreign Application Priority Data

Nov. 17, 2005 (JP) ..... 2005-332530

(51) Int. Cl.
*F01D 5/18* (2006.01)

(52) U.S. Cl. ..... 416/97 R

(58) Field of Classification Search ..... 416/97 R; 415/115

See application file for complete search history.

(56) References Cited

U.S. PATENT DOCUMENTS 5,779,438 A 7/1998 Wilfert
6,050,777 A * 4/2000 Tabbita et al. ..... 416/97 R
6,099,251 A * 8/2000 LaFleur ..... 416/97 R
6,164,912 A * 12/2000 Tabbita et al. ..... 416/97 R

FOREIGN PATENT DOCUMENTS

| | | |
|---|---|---|
| EP | 0 501 813 A1 | 9/1992 |
| EP | 0 810 349 A2 | 12/1997 |
| EP | 1 126 135 A2 | 8/2001 |
| GB | 2 409 243 A | 6/2005 |
| JP | A 4-124405 | 4/1992 |

OTHER PUBLICATIONS

European Search Report for corresponding European application No. 06 12 4256 dated Sep. 25, 2009.

* cited by examiner

*Primary Examiner*—Ninh H Nguyen
(74) *Attorney, Agent, or Firm*—Oliff & Berridge, PLC

(57) ABSTRACT

A film cooling structure includes a wall surface which faces a gas-flow passage for high-temperature gas. One or more than one pair of jetting holes are formed on the wall surface so as to respectively jet cooling media into the gas-flow passage. The pair of jetting holes respectively have jetting directions in which the cooling media are jetted from the pair of jetting holes into the gas-flow passage. The jetting directions of the pair of jetting holes are respectively set so as to respectively form swirls in directions in which the cooling media are mutually pressed against the wall surface.

10 Claims, 4 Drawing Sheets

DOUBLE JET FILM COOLING STRUCTURE

CROSS REFERENCE TO RELATED APPLICATIONS

This application is based upon the prior Japanese Patent Application No. 2005-332530 filed on Nov. 17, 2005, the entire contents of which are incorporated herein by reference.

BACKGROUND OF THE INVENTION

1. Field of the Invention

The present invention relates to a film cooling structure in which jetting holes are formed on a wall surface, which faces a passage of high-temperature gas, of such as moving blades, static blades, and an inner cylinder of a combustor of a gas turbine. A cooling medium jetted from the jetting holes flows along the wall surface so that the wall surface is cooled by the cooling medium.

2. Description of the Related Art

Conventionally, on the wall surface of such as the moving blade of the gas turbine, many jetting holes pointing in the same direction are formed. By a film flow of a cooling medium like air jetted from these jetting holes, the wall surface aforementioned exposing to high-temperature gas is cooled. JP-A 4-124405 shows in FIG. 3 thereof this kind of configuration.

However, conventionally, the cooling medium jetted from the jetting holes into the passage of high-temperature gas is easily separated from the wall surface, so that the film efficiency indicating the cooling efficiency on the wall surface is low. Generally, the film efficiency is about 0.2 to 0.4. Here, the film efficiency is $\eta f,ad=(Tg-Tf)/(Tg-Tc)$, where Tg indicates a gas temperature, Tf a surface temperature of the wall surface, and Tc a temperature of the cooling medium on the wall surface.

SUMMARY OF THE INVENTION

Therefore, the present invention is intended to provide a film cooling structure for enhancing a film efficiency on a wall surface of, e.g., moving and static blades of a gas turbine so that the wall surface can be cooled efficiently.

To accomplish the above object, the film cooling structure according to the present invention includes a wall surface which faces a gas-flow passage for high-temperature gas, wherein one or more than one pair of jetting holes are formed on the wall surface so as to respectively jet cooling media into the gas-flow passage, the pair of jetting holes respectively having jetting directions in which the cooling media are jetted from the pair of jetting holes into the gas-flow passage, the jetting directions of the pair of jetting holes respectively being set so as to respectively form swirls in directions in which the cooling media are mutually pressed against the wall surface.

According to the constitution aforementioned, the cooling media from the pair of jetting holes interfere with each other so that by the swirl flow of the cooling medium on one side, the cooling medium on the other side is pressed onto the wall surface. Thereby, the separation of the cooling medium from the wall surface is suppressed. Therefore, the film efficiency on the wall surface can be enhanced and the wall surface is cooled effectively.

Preferably, jetting speed vectors of the cooling media jetted from the pair of jetting holes respectively have transverse angle components $\beta 1$ and $\beta 2$ on a plane along the wall surface with respect to a flow direction of the high-temperature gas in the gas-flow passage, the transverse angle components $\beta 1$ and $\beta 2$ being different from each other. Therefore, the mutual interference effect of the cooling media can be obtained easily.

Preferably, the transverse angle components $\beta 1$ and $\beta 2$ are directed in opposite directions to each other with respect to the flow direction. By doing this, on the wall surface along the flow direction of high-temperature gas, the film flow of the cooling medium is formed effectively and the film efficiency is improved more.

Preferably, the transverse angle components $\beta 1$ and $\beta 2$ are 5 to 175°. Preferably, the jetting speed vectors respectively have longitudinal angle components $\alpha 1$ and $\alpha 2$ which are perpendicular to the wall surface, the longitudinal angle components $\alpha 1$ and $\alpha 2$ being 5 to 85°. Preferably, each of the pair of jetting holes has a hole diameter D, and the pair of jetting holes are positioned relative to each other with a transverse interval W in an perpendicular direction which is perpendicular to the flow direction and with a longitudinal interval L in the flow direction, the transverse interval W being 0 D to 4 D and the longitudinal interval L being 0 D to 8 D. Preferably, the transverse interval W is 0.5 D to 2 D and the longitudinal interval L is 1.5 D to 5 D. According to these preferred constitutions, strong swirls toward the wall surface are generated and the wall surface can be cooled more effectively.

According to the present invention mentioned above, the separation of the cooling medium on the wall surface exposed to high-temperature gas is suppressed, and a satisfactory film flow can be generated on the wall surface, thus the wall surface can be cooled efficiently.

BRIEF DESCRIPTION OF THE DRAWINGS

The above and other objects, features and advantages of the present invention will become more apparent from the following description taken in connection with the accompanying drawings, in which.

DESCRIPTION OF THE PREFERRED EMBODIMENTS

Hereinafter, the preferred embodiments of the present invention will be explained with reference to the accompanying drawings.

Figure 1:
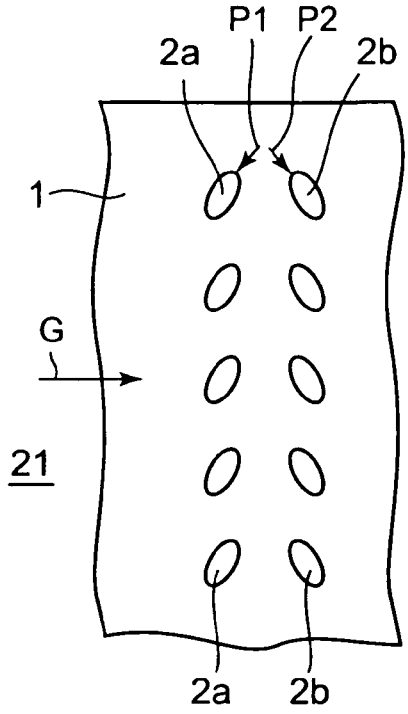
FIG. 1 is a front view of a part of a wall surface exposed to high-temperature gas to which a film cooling structure according to a first embodiment of the present invention is applied.
Figure 2:
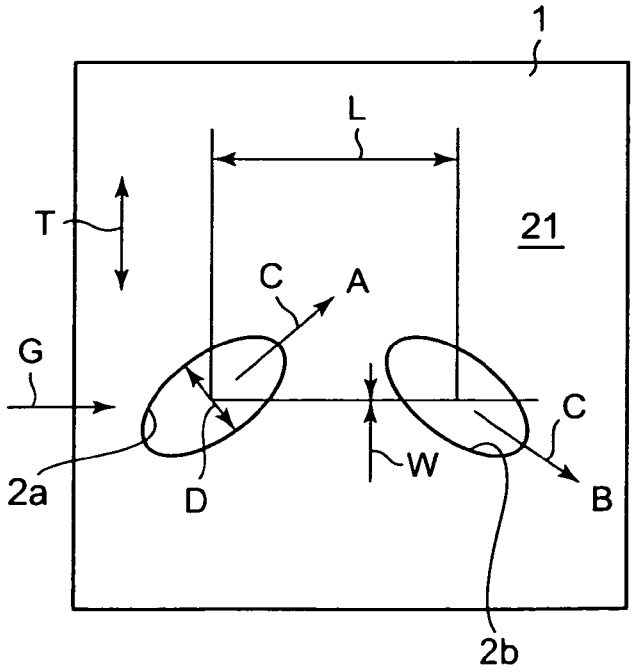
FIG. 2 is a front view showing an enlarged part of the wall surface in which a pair of jetting holes are formed.

In the double jet film cooling structure of the embodiment shown in FIG. 1, a wall surface 1 is exposed to high-temperature gas G flowing in the direction of the arrow. On the wall surface 1, a plurality of first and second jetting holes 2*a* and 2*b*, which are paired back and forth in the flow direction of the high-temperature gas G, are formed vertically at even intervals. From the jetting holes 2*a* and 2*b*, a cooling medium like air is jetted into a passage 21 for the high-temperature gas G. The jetting holes 2*a* and 2*b* are circular holes bored slantwise by a drill in the slant directions P1 and P2 to the wall surface 1. Thereby, each of the jetting holes 2*a* and 2*b* is opened in an elliptic shape on the wall surface 1. These paired jetting holes 2*a* and 2*b*, as shown in the enlarged front view in FIG. 2, are formed so that the jetting directions A and B of the cooling medium C jetted from the jetting holes 2*a* and 2*b* are directed mutually in the different directions on the plane along the wall surface 1, that is, viewed from the direction perpendicular to the wall surface 1. Each of the jetting holes 2*a* and 2*b* has a hole diameter D.

The jetting hole 2*a* and the jetting hole 2*b* are arranged in the flow direction of the high-temperature gas G with a longitudinal interval L. Therefore, when naming the direction perpendicular to the flow direction of the high-temperature gas G and along the wall surface 1 as a transverse direction T, a transverse interval W between the holes 2*a* and 2*b* in the transverse direction T is zero. The longitudinal interval L is three times of the hole diameter D of the jetting holes 2*a* and 2*b* (L=3 D).

Figure 3:
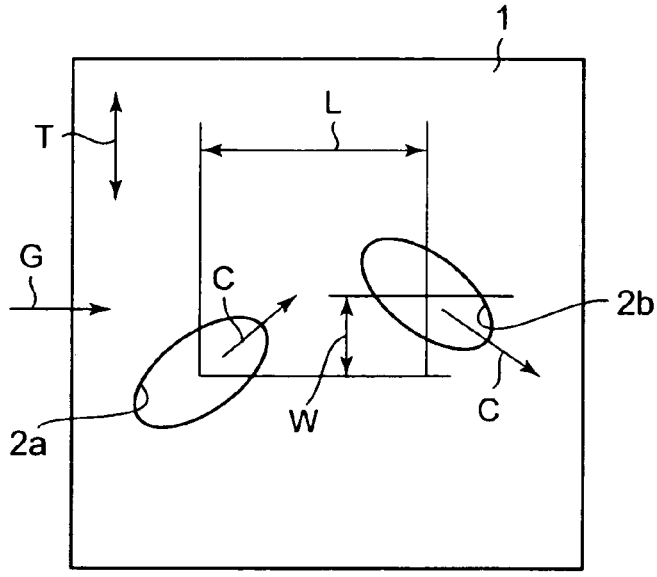
FIG. 3 is a front view of an enlarged part of a wall surface according to a second embodiment.

Further, in the second embodiment shown in FIG. 3, the transverse interval W is equal to 1 D, and the longitudinal interval L is equal to 3 D.

Figure 4:
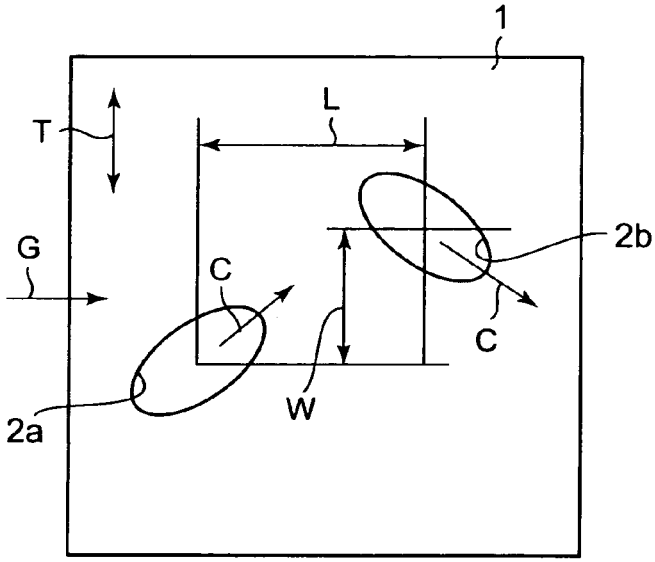
FIG. 4 is a front view of an enlarged part of a wall surface according to a third embodiment.

Moreover in the third embodiment shown in FIG. 4, the transverse interval W is equal to 2 D, and the longitudinal interval L is equal to 3 D.

Figure 5:
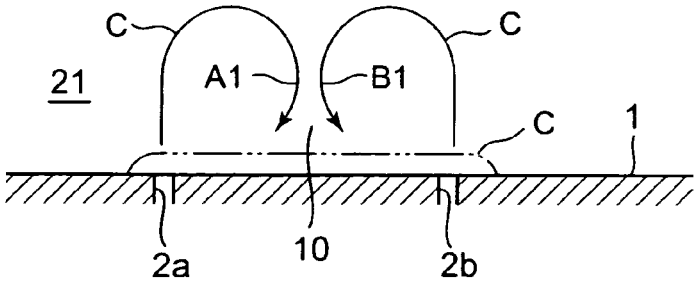
FIG. 5 is a drawing for explaining the flow of cooling medium formed on the outer surface of the wall surface which corresponds to the sectional view of the line V-V in FIG. 7.

The cooling media C jetted from the respective paired jetting holes 2*a* and 2*b* shown in FIGS. 2 to 4 are mutually influenced and act so as to press the counterpart against the wall surface 1. The situation will be explained by referring to FIG. 5. FIG. 5 shows a section perpendicular to the flow direction of the high-temperature gas G. The two jetting holes 2*a* and 2*b* are adjacent to each other, and the jetting directions of the cooling media C from the two holes 2*a* and 2*b* are different from each other as viewed in the direction perpendicular to the wall surface 1. Therefore, a low-pressure portion 10 is generated between the two flows of the cooling media C. Thereby, on the inner sides of the cooling media C, i.e., in the portions opposite to each other, a flow toward the wall surface 1 is generated. By doing this, in the flows of the two cooling media C, swirls A1 and B1 are generated mutually in the opposite directions so as to internally roll in the cooling media C toward the wall surface 1. The swirls A1 and B1 act so as to press mutually the flow of the cooling medium C of the opposite side against the wall surface 1.

To generate effectively the swirls A1 and B1 and produce an interference effect of pressing the mutual cooling media C against the wall surface 1, it is necessary to separate the two jetting holes 2*a* and 2*b* at an appropriate distance. Therefore, the transverse interval W between the jetting holes 2*a* and 2*b* shown in FIGS. 3 and 4 is set to 0D to 4D, preferably 0.5D to 2D. Further, the longitudinal interval L between the jetting holes 2*a* and 2*b* in the flow direction of the high-temperature gas G is set to 0 D to 8 D, preferably 1.5 D to 5 D. When the transverse interval W and longitudinal interval L exceed respectively 4 D and 8 D, the two cooling media C are excessively separated from each other so that the mutual interference effect is lowered.

Figure 6:
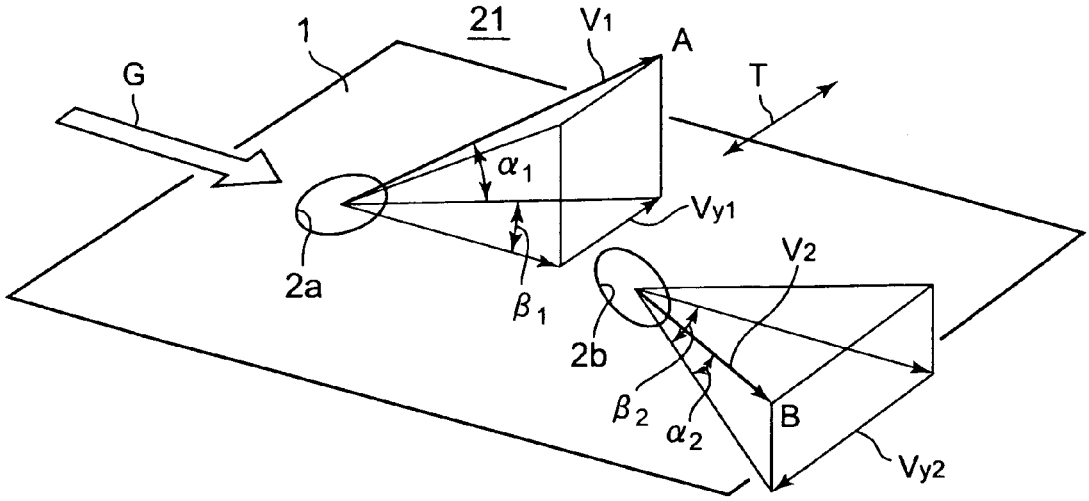
FIG. 6 is a perspective view for explaining the configurations of the jetting holes.

FIG. 6 shows the directions of the cooling media C jetted from each of a pair of jetting holes 2*a* and 2*b*. The jetting speed vectors V1 and V2 of the two cooling media C, as viewed in the direction perpendicular to the wall surface 1, are directed in the different directions A and B from each other. Namely, the jetting speed vectors V1 and V2 respectively have the transverse angle components β1 and β2 on the plane along the wall surface 1 which are different from each other with respect to the flow direction of the high-temperature gas G. Furthermore, the speed components Vy1 and Vy2 in the transverse direction T of the jetting speed vectors V1 and V2 are directed mutually in the opposite directions. Namely, the transverse angle components β1 and β2 are directed mutually in the opposite directions with respect to the flow direction of the high-temperature gas G.

The transverse angle components β1 and β2 of the angle formed by the jetting speed vectors V1 and V2 with respect to the flow direction of the high-temperature gas G are 5 to 175°, preferably 20 to 60°. Further, the longitudinal angle components α1 and α2 of the angle perpendicular to the wall surface 1 are 5 to 85°, preferably 10 to 50°. Within this range, the interference effect aforementioned is produced.

Figure 7:
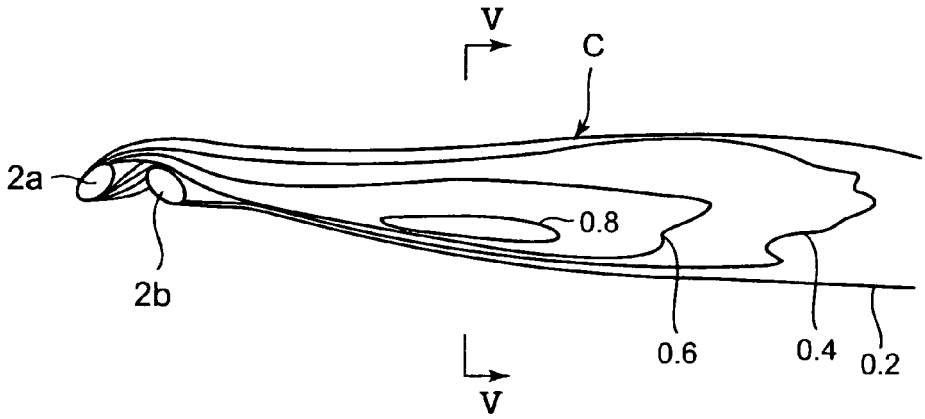
FIG. 7 is an equivalent value chart of the film efficiency obtained on the wall surface.

According to the cooling structure aforementioned, as shown in FIG. 5, the cooling media C from each of a pair of jetting holes 2*a* and 2*b* interfere with each other by the swirls A1 and B1 so that the flow of the cooling medium C of the opposite side is pressed against the wall surface 1. Therefore, the cooling media C make contact with the wall surface 1 over a wide range, and the film flow of the cooling media C is formed. FIG. 7 shows an equivalent value chart of the film efficiency ηf,ad obtained on the wall surface 1, when the jetting holes 2*a* and 2*b* shown in FIG. 2 are formed. As clearly shown in the drawing, the cooling media C jetted from the jetting holes 2*a* and 2*b* interfere with each other, thus in the downstream area thereof, an area of a film efficiency of 0.8 is formed. Around this area, an area of a film efficiency of 0.6 is formed. Furthermore, around this area, areas of film efficiencies of 0.4 and 0.2 are formed respectively over a wide range. The film flow of the cooling media C having a high film efficiency like this is formed on the wall surface 1, thus the cooling media C are prevented from separation from the wall surface 1 and the wall surface 1 is cooled efficiently. Further, the transverse angle components β1 and β2 of the jetting speed vectors V1 and V2 shown in FIG. 6 are directed in the opposite directions with respect to the flow direction of the high-temperature gas G, so that on the wall surface 1 along the flow direction of the high-temperature gas G, the film flow of the cooling media C is formed effectively, and the film efficiency is improved more. FIG. 5 is a sectional view of the line V-V sectioned in the neighborhood of the film efficiency of 0.8 shown in FIG. 7.

Figure 8:
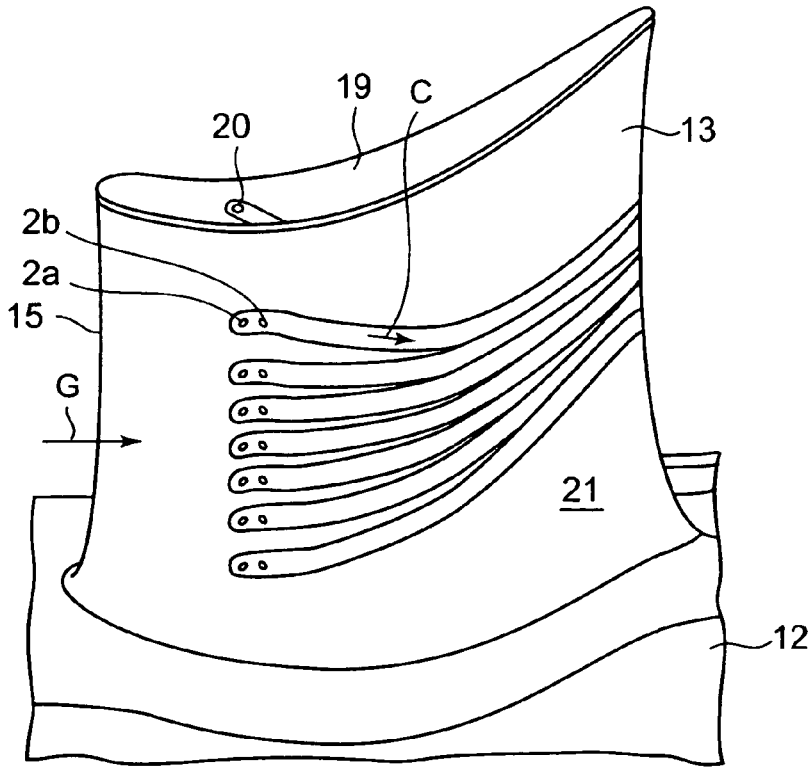
FIG. 8 is a perspective view of a turbine moving blade to which the embodiment of the present invention is applied.
Figure 9:
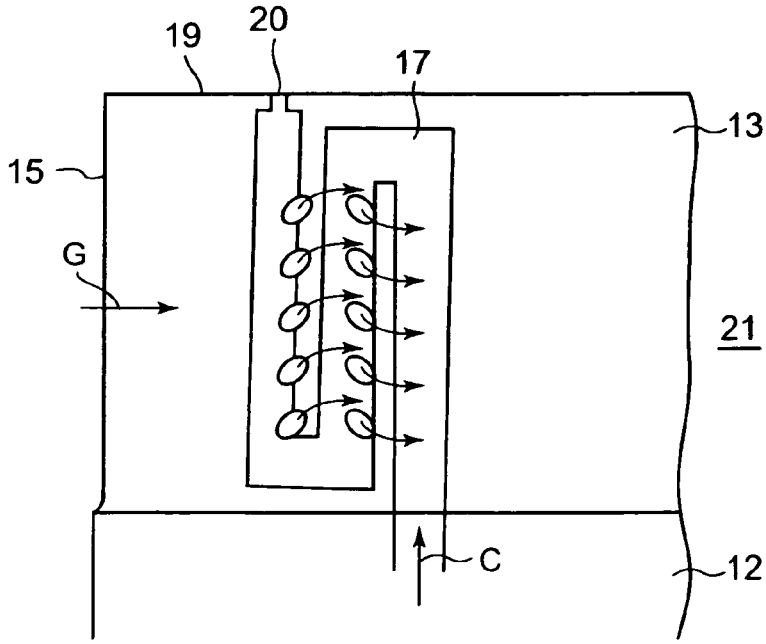
FIG. 9 is a longitudinal sectional view of the turbine moving blade.

FIGS. 8 and 9 show an example that the present invention is applied to turbine blades of a gas turbine. The gas turbine includes a compressor for compressing air, a combustor for feeding fuel to the compressed air from the compressor and burning the same, and a turbine driven by combustion gas at high temperature and pressure from the combustor. The turbine includes many moving blades 13 implanted on the outer periphery of a turbine disk 12 shown in FIG. 8. On the portion slightly behind a leading edge 15 of the blade surface (the wall surface 1) on the back side of the moving blades 13, seven pairs of jetting holes 2*a* and 2*b* are arranged side by side in the radial direction, and these jetting holes 2*a* and 2*b* face the passage 21 for high-temperature gas (combustion gas) between the neighboring moving blades 13. The respective paired jetting holes 2*a* and 2*b* are the same as those shown in FIG. 2, and the jetting holes 2*a* are positioned on the upstream side of the high-temperature gas passage 21 with respect to the jetting holes 2*b*.

Inside the moving blades 13, a folded cooling medium passage 17 shown in FIG. 9 is formed and to the halfway portion of the cooling medium passage 17, the jetting holes 2*b* are interconnected and to the downstream portion, the jetting holes 2*a* are interconnected. The cooling medium C composed of air extracted from the compressor is introduced into the cooling medium passage 17 from the passage in the turbine disk 12 and is jetted from the jetting holes 2*b* and 2*a*. Then, the remaining cooling medium C is jetted into the passage 21 from the jetting holes 20 opened at a blade end 19. As mentioned above, by the cooling media C jetted from the jetting holes 2*a* and 2*b* opened on the blade surface which is the wall surface 1 shown in FIG. 8, the film flow of the cooling media C is formed on the blade surface 1 so that the moving blades 13 are cooled effectively.

In the embodiment aforementioned, the example in which a pair of jetting holes 2*a* and 2*b* as a set are formed is explained. However, in the present invention, a set of more than two jetting holes may be formed. In such a configuration, swirls are formed such that at least one pair of jetting holes in each set interferes with each other so that the cooling media are pressed against the wall surface.

The present invention can be widely applied to a wall surface facing a passage for high-temperature gas such as not only moving blades of a gas turbine but also static blades and an inner cylinder of a combustor thereof.

Although the invention has been described in its preferred embodiments with a certain degree of particularity, obviously many changes and variations are possible therein. It is therefore to be understood that the present invention may be practiced otherwise than as specifically described herein without departing from the scope and spirit thereof.

What is claimed is:

1. A film cooling structure comprising a wall outer surface which faces a gas-flow passage for high-temperature gas, wherein one or more than one pair of jetting holes are formed on the wall outer surface so as to respectively jet cooling media into the gas-flow passage, the pair of jetting holes respectively having jetting directions in which the cooling media are jetted from the pair of jetting holes into the gas-flow passage, the jetting directions of the pair of jetting holes respectively being set so as to respectively form swirls in directions in which the cooling media are mutually pressed against the wall outer surface.

2. A film cooling structure according to claim 1, wherein each of the pair of jetting holes has a hole diameter D, and wherein the pair of jetting holes are positioned relative to each other with a transverse interval W in an perpendicular direction which is perpendicular to the flow direction and with a longitudinal interval L in the flow direction, the transverse interval W being 0 D to 4 D and the longitudinal interval L being 0 D to 8 D.

3. A film cooling structure comprising a wall surface which faces a gas-flow passage for high-temperature gas, wherein one or more than one pair of jetting holes are formed on the wall surface so as to respectively jet cooling media into the gas-flow passage, the pair of jetting holes respectively having jetting directions in which the cooling media are jetted from the pair of jetting holes into the gas-flow passage, the jetting directions of the pair of jetting holes respectively being set so as to respectively form swirls in directions in which the cooling media are mutually pressed against the wall surface, wherein jetting speed vectors of the cooling media jetted from the pair of jetting holes respectively have transverse angle components $\beta 1$ and $\beta 2$ on a plane along the wall surface with respect to a flow direction of the high-temperature gas in the gas-flow passage, the transverse angle components $\beta 1$ and $\beta 2$ being different from each other.

4. A film cooling structure according to claim 3, wherein the transverse angle components $\beta 1$ and $\beta 2$ axe directed in opposite directions to each other with respect to the flow direction.

5. A film cooling structure according to claim 4, wherein the transverse angle components $\beta 1$ and $\beta 2$ are 5 to 175°.

6. A film cooling structure according to claim 4, wherein the jetting speed vectors respectively have longitudinal angle components $\alpha 1$ and $\alpha 2$ which are perpendicular to the wall surface, the longitudinal angle components $\alpha 1$ and $\alpha 2$ being 5 to 85°.

7. A film cooling structure according to claim 3, wherein the transverse angle components 131 and $\beta 2$ are 5 to 175°.

8. A film cooling structure according to claim 7, wherein the jetting speed vectors respectively have longitudinal angle components $\alpha 1$ and $\alpha 2$ which are perpendicular to the wall surface, the longitudinal angle components $\alpha 1$ and $\alpha 2$ being 5 to 85°.

9. A film cooling structure according to claim 3, wherein the jetting speed vectors respectively have longitudinal angle components $\alpha 1$ and $\alpha 2$ which are perpendicular to the wall surface, the longitudinal angle components $\alpha 1$ and $\alpha 2$ being 5 to 85°.

10. A film cooling structure comprising a wall surface which faces a gas-flow passage for high-temperature gas, wherein one or more than one pair of jetting holes are formed on the wall surface so as to respectively jet cooling media into the gas-flow passage, the pair of jetting holes respectively having jetting directions in which the cooling media are jetted from the pair of jetting holes into the gas-flow passage, the jetting directions of the pair of jetting holes respectively being set so as to respectively form swirls in directions in which the cooling media are mutually pressed against the wall surface, wherein each of the pair of jetting holes has a hole diameter D, and wherein the pair of jetting holes are positioned relative to each other with a transverse interval W in an perpendicular direction which is perpendicular to the flow direction and with a longitudinal interval L in the flow direction, wherein the transverse interval W is 0.5 D to 2 D and the longitudinal interval L is 1.5 D to 5 D.

* * * * *